US006572511B1

(12) United States Patent
Volpe

(10) Patent No.: US 6,572,511 B1
(45) Date of Patent: Jun. 3, 2003

(54) HEART RATE SENSOR FOR CONTROLLING ENTERTAINMENT DEVICES

(76) Inventor: Joseph Charles Volpe, 115 Jaffrey Rd., Malvern, PA (US) 19355

( * ) Notice: Subject to any disclaimer, the term of this patent is extended or adjusted under 35 U.S.C. 154(b) by 0 days.

(21) Appl. No.: 09/711,372

(22) Filed: Nov. 10, 2000

Related U.S. Application Data

(60) Provisional application No. 60/165,011, filed on Nov. 12, 1999.

(51) Int. Cl.[7] ..... A63B 21/00

(52) U.S. Cl. ..... 482/4; 482/8; 600/519

(58) Field of Search ..... 482/1–9, 51, 54, 482/57, 900, 901, 902; 600/481, 483, 486, 508, 514, 519

(56) References Cited

U.S. PATENT DOCUMENTS 3,595,219 A * 7/1971 Friedlander ..... 600/519
3,863,626 A * 2/1975 Huber ..... 600/519
5,362,069 A * 11/1994 Hall-Tipping ..... 482/8
5,462,504 A * 10/1995 Trulaske et al. ..... 482/7
5,524,637 A * 6/1996 Erickson ..... 482/8
5,527,239 A * 6/1996 Abbondanza ..... 482/8
5,888,172 A * 3/1999 Andrus et al. ..... 482/7
5,921,891 A * 7/1999 Browne ..... 482/8
6,004,243 A * 12/1999 Ewert ..... 482/8
6,251,048 B1 * 6/2001 Kaufman ..... 482/8
6,304,774 B1 * 10/2001 Gorman ..... 600/520

* cited by examiner

*Primary Examiner*—Glenn E. Richman
(74) *Attorney, Agent, or Firm*—Dann, Dorfman, Herrell and Skillman; Henry H. Skillman

(57) ABSTRACT

Described is a motivational fitness device, which controls volume and power on a television or stereo component in response to the heart rate. The user must exercise in their specific heart rate target training range to keep their entertainment device turned on at an enjoyable volume. A heart rate sensing device relays heart rate to a remote control unit. The control unit receives and compares the users heart rate to the specified target range and sends infrared remote control signals (or not) to the entertainment device. If the user's heart rate drops below the target range, the volume of their entertainment device will gradually decrease and ultimately switch off until the user reacquires their target. Conversely, if the user is exercising too vigorously the volume will increase, motivating the user to reacquire their target heart rate range. This device requires no exercise equipment yet any type may be used with it.

13 Claims, 4 Drawing Sheets

HEART RATE SENSOR FOR CONTROLLING ENTERTAINMENT DEVICES

This application claims benefit of Ser. No. 60/165,011 filed Nov. 12, 1999.

BACKGROUND OF THE INVENTION

While the benefits of exercise are well known, it is often the case that one lacks the motivation to exercise regularly and at optimal intensity. Several attempts have been made to develop devices, which entertain or motivate a person during exercise. The prior art holds various examples of exercise intensity sensing devices connected to electronic devices. However, such equipment is bulky and expensive. Furthermore, a complex apparatus, which integrates an exercise device with a video apparatus or other audio/visual components to stimulate exercise, cannot be easily adapted to the existing base of exercise equipment found in the home. Some of the existing examples use proprietary audio/visual equipment such as variable speed video players or devices, which produce television type images. Some employ heart rate target training strategies. Thus, there is a need in the art for a simple, adaptable, inexpensive and less cumbersome device, which provides the user with effective motivational feedback to encourage optimal exercise.

U.S. Pat. No. 5,362,069 describes an exercise device/video game, which senses the speed of a pedaled exercise device and heart rate of the user. These signals are used to alter both the difficulty (resistance) of the exercise device and the play of the video game. This apparatus is dependent upon a fixed exercise device or one whereby ergonomic speed can be sensed. The entertainment form is active (interactive gaming.)

U.S. Pat. No. 5,896,164 describes a video biofeedback apparatus that produces television displays that change with users psychophysiological parameters. The display is dependent on pre-recorded video signals on a videocassette. It does not offer entertainment as a motivational element.

U.S. Pat. No. 4,278,095 describes a pre-recorded variable speed video display, which is affected by the ergonomic speed of an exercise device (treadmill.) It is dependent upon a variable speed video cassette player and a dedicated exercise machine. The entertainment form is passive but "canned" being limited to the prerecorded outdoor exercise scenes, which vary only in the speed of playback.

U.S. Pat. No. 5,779,596 describes the remote control of an electronic device with input signals generated by an exercise device fitted with a speed sensor. This is dependent on a fixed exercise device and/or ergonomic speed sensor and the entertainment device is limited to only two operational modes. It does not incorporate heart rate target training as a means of inducing optimal results.

U.S. Pat. No 5,527,239 describes an exercise device capable of responding to user heart rate and adjusting the physical resistance of the fixed exercise device. The video display is a graphic representation of heart rate.

BRIEF SUMMARY OF THE INVENTION

A modified universal infrared (IR) remote controller for television and audio components which is triggered by its user's heart rate.

The objective of the invention is to provide a more powerful motivation (entertainment) for optimal exercise (target heart rate training) in a simpler, more universally adaptable and less expensive form than is found in the prior art.

The present invention specifically improves upon the prior art by incorporating heart rate target training and passive entertainment and by being independent of bulky and expensive exercise equipment. It provides a variable and continuous form of feedback in the form of entertainment volume changes.

Being able to enjoy audio/visual entertainment rewards the user. Heart rate target training goals are the basis for establishing optimal exercise.

A user simply exercises, with or without any type of exercise equipment and watches TV or listens to their stereo. A heart rate monitor combined with a wireless transmitter sends data to a nearby control unit. Within the control unit, a proprietary microprocessor commands the IR remote control to alter the volume or power settings on the entertainment device in accordance with pre-programmed parameters and individualized user settings for age and intensity level. If the user's heart rate moves below or above the recognized target range, volume is gradually altered and ultimately power interrupted until the user reacquires the target range.

There are examples in the prior art of heart rate sensing devices controlling exercise equipment or video games. The field is also crowded with examples of speed sensing exercise devices to control electronic equipment. None of the prior art incorporates the benefits of heart rate target training with the simple motivational reward of watching television or listening to music. Further, the present invention is usable with any exercise equipment or none at all, is simple, lightweight and less expensive to produce than those found in the prior art.

DETAILED DESCRIPTION OF THE INVENTION

Figure 1:
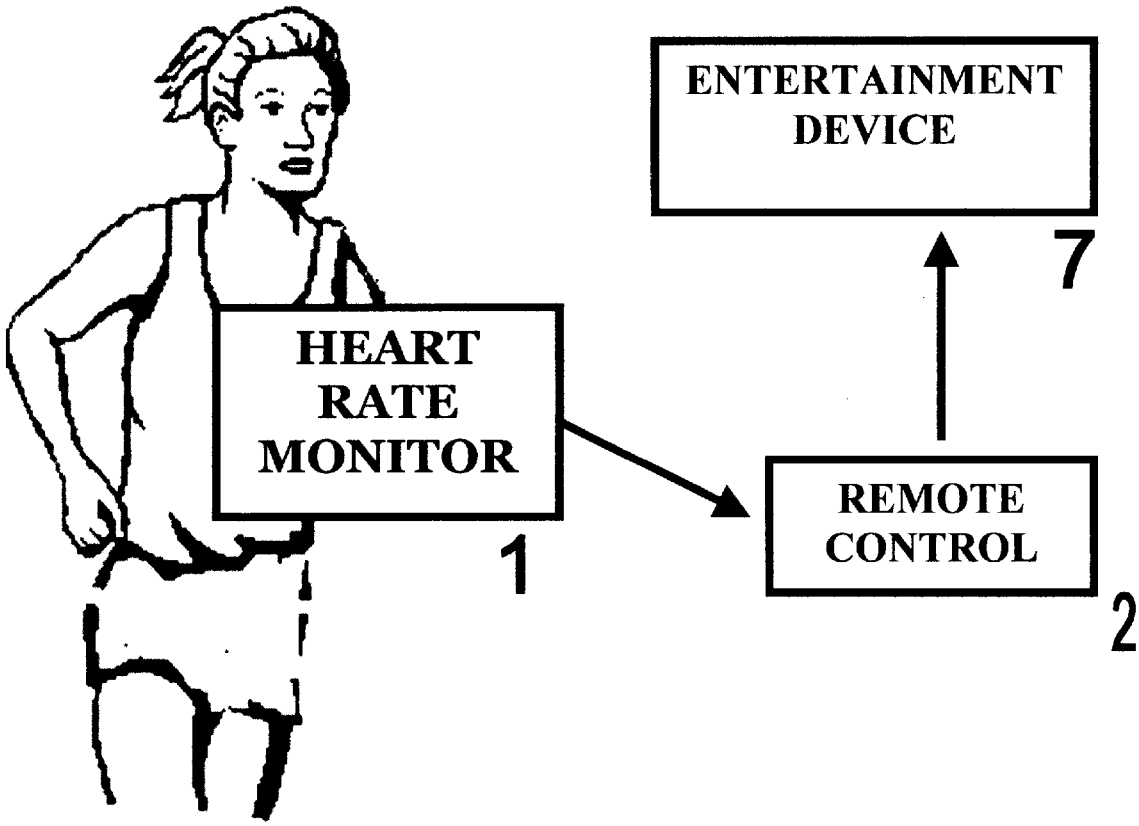
FIG. 1 illustrates the concept of controlling entertainment devices with a heart rate monitor.
Figure 2:
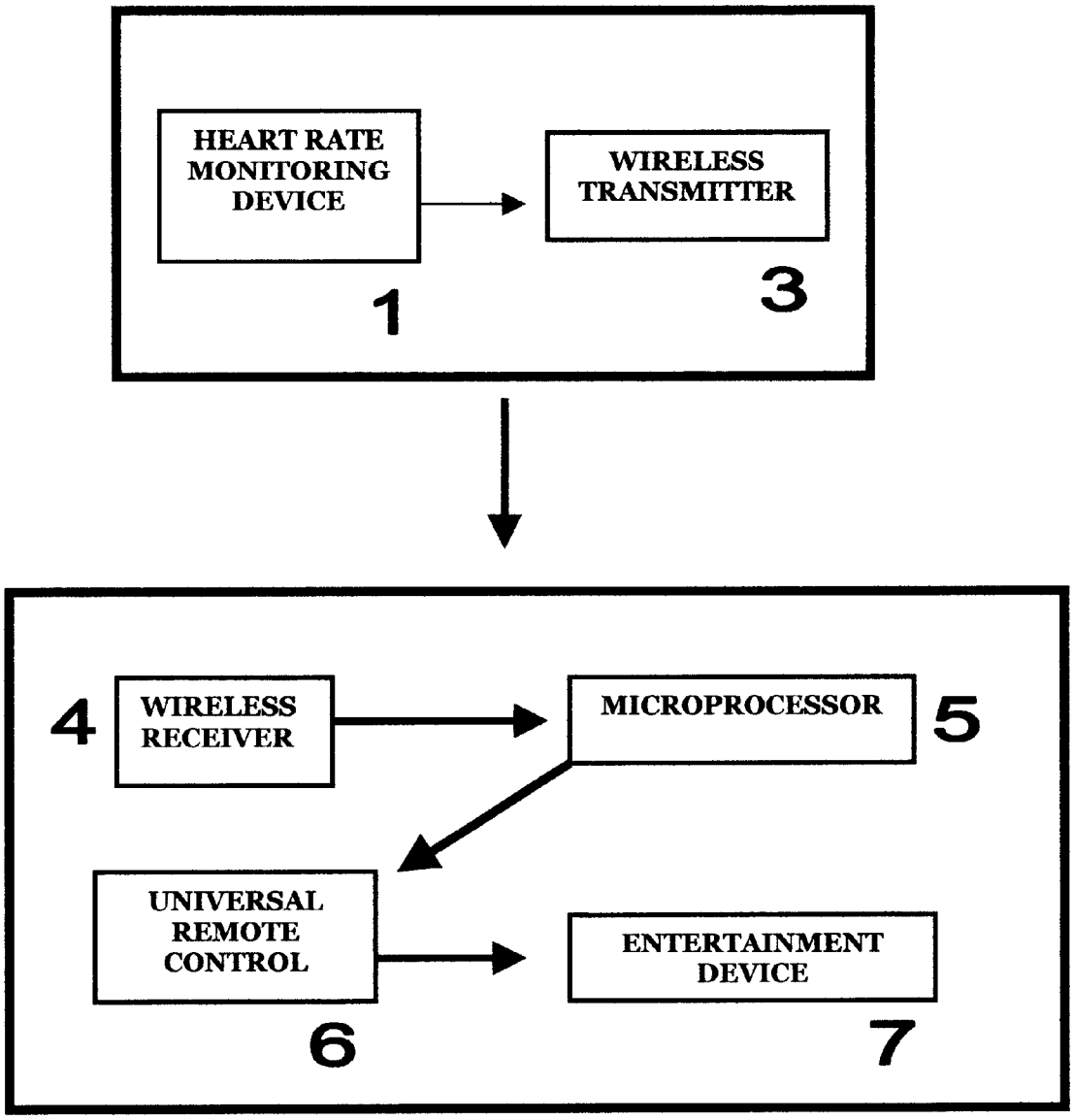
FIG. 2 shows the preferred embodiment of the present invention and the components from which it is comprised.
Figure 3:
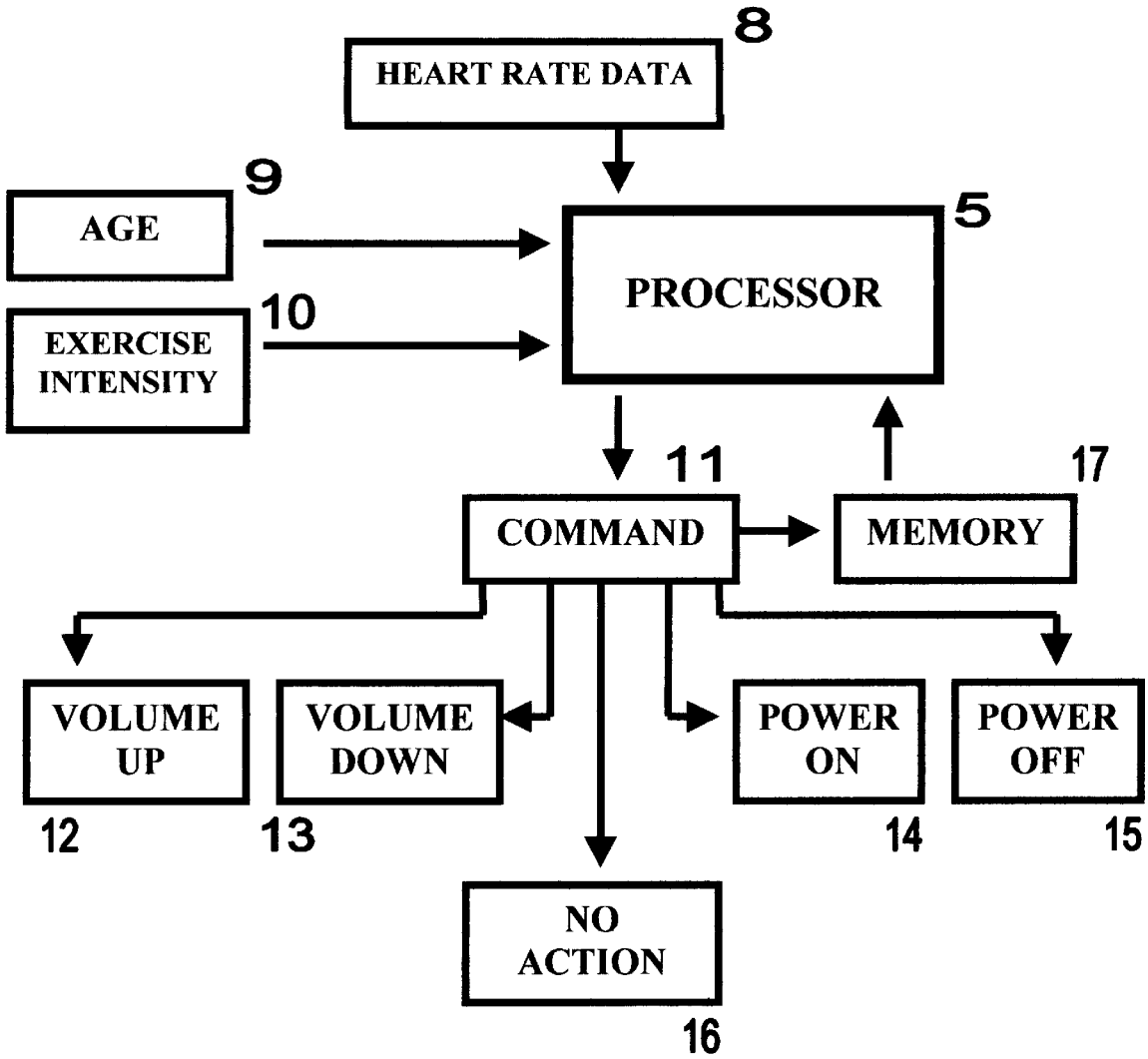
FIG. 3 is a flow chart of the logic used by the microprocessor.

A chest strap type of heart rate monitor 1, such as those manufactured by Polar, is modified to transmit wireless heart rate data 3. The remaining functions are carried out by several components contained within a controller unit 2, which are interconnected by electronic circuitry. Said controller unit receives the heart rate data 4. That data is fed to a microprocessor 5 which is programmed to compare it with a desired target range at regular time intervals. Based on that comparison the microprocessor will send a command (or not) to the universal remote control 6 to send volume control and power control signals to the entertainment device 7. The control unit must be in a line of sight to the entertainment device to allow for uninterrupted remote control.

Figure 4:
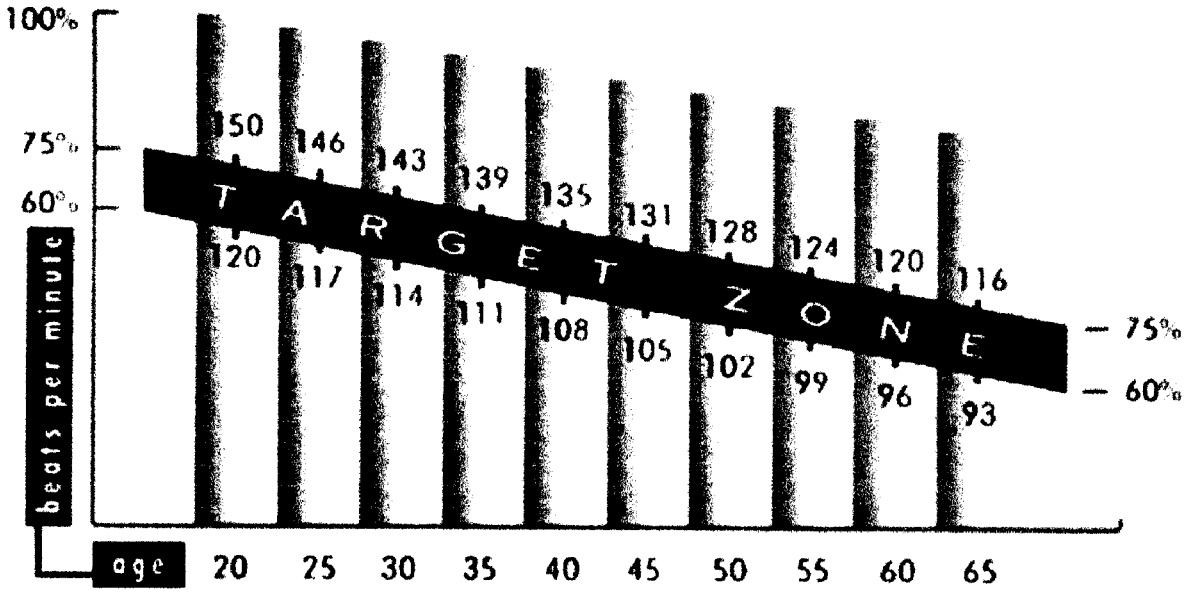
FIG. 4 shows a graphic table of target training heart rates

The processor 5 receives heart rate data 8 and compares it to the target rates described in FIG. 4., which are conditioned by the user inputs for age 9 and exercise intensity 10. The processor 5 sends a command 11 at periodic intervals. The command may be either volume up 12, volume down 13, power on 14, power off 15 or no action 16. Each command during the exercise period is tracked by the memory 17 which further conditions the commands sent by the processor 5.

The processor keeps track of all commands sent to the entertainment device 7 so that it may condition each new command based upon the current status of the entertainment device. The processor has no direct feedback from the entertainment device and thus begins its calculations with an understood zero baseline volume level. This corresponds to the comfortable listening volume on the entertainment device set by the user prior to commencing exercise. So, for example, if the processor calculates that there is a sum of total of one volume down 13 command and the user's heart rate is still below target at the next periodic interval, the processor will send another volume down command. If, however, the prior command was power off 15 and the user has reacquired the target, a power on 14 command would be sent.

Although the preferred embodiment described above is specific for purposes of illustration, other permutations of the combination heart rate monitor and universal remote control are possible within the spirit and scope of the invention. For example, the chest strap heart rate monitor may be replaced with other types of heart rate monitoring devices, such as finger clips, ear clips, arm bands etc. The wireless features may employ various technologies or be replaced with hard-wired connectivity. And, the logic used by the microprocessor to effect the desired result of motivating heart rate target training exercise by controlling an entertainment device, may vary in possible permutations of the invention.

The varied target ranges available to the user are based upon generally accepted targets outlined in the attached graph in FIG. 4. These target ranges are further altered by the processor in response to user settings for age and exercise intensity. The user switches exercise intensity to either "fat burning" or "cardio-fitness." For example a 40 year-old desiring optimal target training for weight loss would set the age switch to 40 and the intensity to fat burning. That person could alternatively set the intensity switch to cardio-fitness for a more strenuous workout.

Example of Practical Use

Before exercising, the user would set the control unit to communicate with their chosen entertainment device. To exercise, the user would turn on a desired television or audio program and set a comfortable baseline listening volume. She would then turn on the present device and commence exercise. Within the controller unit 2 the microprocessor 5 starts a clock. After a warm-up period, the microprocessor begins, at regular intervals, to sample the user's real-time heart rate and compare it to the target. The user may comfortably enjoy his entertainment as long as his heart is beating in the desired range. The user is quickly motivated to correct his exercise intensity by the changing volume or power condition of the entertainment device.

What is claimed:

1. Motivational fitness apparatus for a person to use while exercising with an entertainment device having a power supply, at least an audio output operable to be set at a given volume which is a comfortable listening volume, and a receiver for receiving a first infra-red remote command signal for modulating audio output above and below said given volume and a second infra-red remote command signal for shutting off the power supply, said apparatus comprising:

a remote controller operable to generate first and second infra-red remote command signals directed to the receiver of the entertainment device, a monitor operable to generate heart rate data of the person; and a processor in said remote controller operable to first establish a target range of data, and second to receive said heart rate data from said monitor and compare said data with said target range of data, and to generate a command indicative of the variation of said heart rate data relative to said target range, and means to direct said generated command to activate at least one of said first and second infra-red remote command signals.

2. Apparatus according to claim 1 wherein said generated command is the first infra-red remote command signal and increases the volume of the audio output above said given volume when the heart rate data is above said target range and decreases the volume of the audio output below said given volume when the heart rate data is below said target range.

3. Apparatus according to claim 1 wherein said processor is operable to establish a second target range which has limits beyond said first target range, and then to compare said data with first and second target ranges and to generate a first signal upon comparison with the first of said ranges, and a second signal upon comparison with the second of said ranges, said first signal comprising the first infra-red remote command signal modulating the audio output and the second signal comprising the second infra-red remote command signal for shutting off the power supply.

4. Apparatus according to claim 3 wherein said processor includes a setting device operable by the person to adjust said first and second target ranges.

5. Apparatus according to claim 1 wherein said processor has means to direct a series of said command infra-red signals to said receiver at periodic intervals and means to keep track of all of said command infra-red signals and to generate new commands based on the status of the receiver resulting from tracked commands.

6. Apparatus according to claim 1 wherein said remote controller is operable to establish two target ranges, and said processor has means to compare said data with said two target ranges and to generate a first infra-red signal upon comparison with the first of said two target ranges, and a second infra-red signal upon comparison with the second of said two target ranges, said first infra-red signal operable to modulate the audio output and the second infra-red signal operable to shut off the power supply.

7. Apparatus according to claim 6 wherein said second target range is greater than said first target range, said second infra-red signal shutting off said power when said heart rate data falls outside of said second target range.

8. A method for motivating a person doing fitness exercises comprising the steps of providing an entertainment device having a power supply, at least an audio output operable to be set at a given volume which is a comfortable listening volume, and a receiver for receiving a first infra-red remote command signal for modulating audio output above and below said given volume and a second infra-red remote command signal for controlling the power supply, providing a remote controller operable to generate first and second infra-red remote command signals directed to the receiver of the entertainment device, monitoring the heart of the person and generating heart rate data of the person;

comparing said data with a target range of data, and generating at least one command infra-red signal indicative of the variation of said heart rate data relative to said target range; and using said remote controller to direct said generated command infra-red signal to said receiver.

9. A method according to claim 8 wherein said generating step generates an audio infra-red signal which controls the volume of the audio output.

10. A method according to claim 9 wherein said audio infra-red signal decreases the volume of said audio output when the heart rate falls below said target range.

11. A method according to claim 9 wherein said audio infra-red signal increases the volume of the audio output when the heart rate rises above said target range.

12. A method according to claim 9 wherein said generating step also generates a power infra-red signal which shuts off the power supply when the heart rate falls outside the target range.

13. A method according to claim 12 wherein said power infra-red signal turns on the power when the heart rate falls back into the target range after falling outside the target range.

* * * * *